US010267501B1

(12) United States Patent
Lowchareonkul

(10) Patent No.: US 10,267,501 B1
(45) Date of Patent: Apr. 23, 2019

(54) SELF-ADAPTABLE LIGHT SOURCE

(71) Applicant: Phahol Lowchareonkul, Los Altos Hills, CA (US)

(72) Inventor: Phahol Lowchareonkul, Los Altos Hills, CA (US)

( * ) Notice: Subject to any disclaimer, the term of this patent is extended or adjusted under 35 U.S.C. 154(b) by 437 days.

(21) Appl. No.: 14/922,036

(22) Filed: Oct. 23, 2015

(51) Int. Cl.

| | |
|---|---|
| ***F21L 4/00*** | (2006.01) |
| ***F21V 23/00*** | (2015.01) |
| ***F21L 19/00*** | (2006.01) |
| *F21Y 101/02* | (2006.01) |
| *F21V 14/02* | (2006.01) |
| *F21V 23/04* | (2006.01) |
| *F21L 4/02* | (2006.01) |

(52) U.S. Cl.
CPC ..... *F21V 23/005* (2013.01); *F21L 4/005* (2013.01); *F21L 19/00* (2013.01); *F21L 4/02* (2013.01); *F21V 14/02* (2013.01); *F21V 14/025* (2013.01); *F21V 23/0492* (2013.01); *F21Y 2101/02* (2013.01)

(58) Field of Classification Search
CPC ... F21L 19/00; F21L 4/00; F21L 4/005; F21L 4/02; F21L 4/022; F21L 4/027; F21L 4/045; F21L 4/085; F21V 14/025; F21V 14/045; F21V 14/065; F21V 23/005; F21V 23/0492
See application file for complete search history.

(56) References Cited

U.S. PATENT DOCUMENTS

| | | | | |
|---|---|---|---|---|
| 6,357,893 | B1 * | 3/2002 | Belliveau | F21L 4/027 257/E25.028 |
| 8,456,329 | B1 * | 6/2013 | Tran | G08C 17/02 341/20 |
| 2008/0272928 | A1 * | 11/2008 | Shuster | F21L 4/027 340/815.75 |
| 2010/0219775 | A1 * | 9/2010 | Maglica | F21L 4/045 315/362 |
| 2013/0176747 | A1 * | 7/2013 | Sparrow | H05B 33/0854 362/473 |
| 2015/0338076 | A1 * | 11/2015 | Garcia | F21V 23/0442 362/205 |
| 2016/0278184 | A1 * | 9/2016 | Van De Sluis | H05B 33/0854 |

* cited by examiner

*Primary Examiner* — Zheng Song
(74) *Attorney, Agent, or Firm* — Kevin Roe

(57) ABSTRACT

Self-adaptable light source and methods to make various types of a light source for the benefit of a user. One embodiment is a method of making a self-adaptable light source. A second embodiment is a self-adaptable light source that has a data processor. A third embodiment is a self-adaptable light source that has two accelerometers. Various embodiments have one or no buttons needed to change the operational state of the light source.

18 Claims, 18 Drawing Sheets

SELF-ADAPTABLE LIGHT SOURCE

BACKGROUND OF THE INVENTION

Field of the Invention

This invention relates generally to the field of light sources, and more specifically to providing self-adaptable light sources.

Description of the Prior Art

Light sources (e.g., flashlights, lanterns, light fixtures (both portable and fixed), and equivalents) have been known and used for many years, but such light sources have been limited in their usefulness.

One problem with prior art light sources is that they require mechanical movements by a user to focus a light beam (e.g., the user must move or twist something on the prior art light source to change it from producing a narrow beam to producing a wide beam or vice versa) or to change the light source from a lantern into a flashlight or vice versa. Another problem with the prior art light sources is that they do not indicate when their battery will run out. Prior art light sources are unintelligent and do not give the user valuable information about the battery of the light source or estimate the operational time remaining

SUMMARY OF THE INVENTION

The present invention provides methods to manufacture a self-adaptable light source and implementations of self-adaptable light sources. Embodiments of the invention can be implemented in numerous ways. Three aspects of the invention are described below.

A first aspect of the invention is directed to a method to make a self-adaptable light source. The method includes fabricating one or more substrates, wherein the one or more substrates can support one or more lights and a data processor; coupling one or more batteries to the one or more substrates; coupling an accelerometer to the one or more batteries; coupling a data processor to the accelerometer; coupling a plurality of lights to the data processor, wherein the data processor can change the operation of the plurality of lights depending on the orientation of the intelligent light source; and placing the one or more substrates inside a self-adaptable light source body and head to assemble a complete unit.

A second aspect of the invention is directed to a self-adaptable light source. The self-adaptable light source includes one or more substrates that can support a plurality of lights and a data processor; one or more batteries, wherein the one or more batteries are coupled to the one or more substrates; an accelerometer coupled to the one or more batteries; a data processor coupled to the one or more batteries and the accelerometer; and a plurality of lights coupled to the data processor, wherein the data processor can change the operation of the plurality of lights depending on the orientation of the self-adaptable light source.

A third aspect of the invention is directed to a method of making a self-adaptable light source. The method of making a self-adaptable light source includes fabricating one or more substrates, wherein the one or more substrates can support one or more lights and a data processor; coupling one or more batteries to the one or more substrates; coupling an accelerometer to the one or more batteries; coupling a data processor to the first accelerometer; coupling a plurality of lights to the data processor, wherein the data processor can change the operation of the plurality of lights depending on the orientation of the self-adaptable light source; coupling an optional second accelerometer to the data processor and the one or more batteries; and placing the one or more substrates inside a self-adaptable light source body and head to assemble a complete unit.

BRIEF DESCRIPTION OF THE DRAWINGS

Non-limiting and non-exhaustive embodiments of the invention are described with reference to the following figures or drawings.

DETAILED DESCRIPTION OF THE PREFERRED EMBODIMENTS

Figure 1:
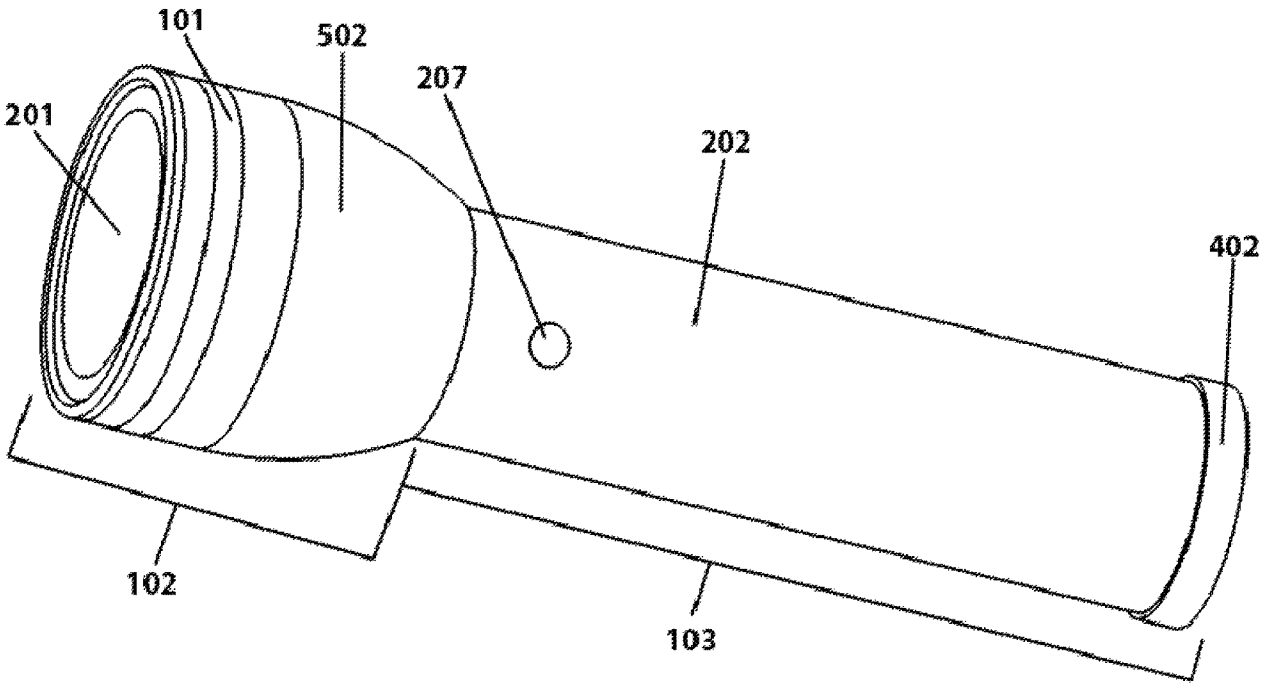
FIG. 1 illustrates a basic self-adaptable light source, in accordance with one embodiment of the invention.

Embodiments of the inventions can be constructed from off-the-shelf components. In all of the embodiments disclosed below, different materials could be used for the self-adaptable light source, including but not exclusively: various plastics, resins, papers, fabrics, plant fibers, ceramics, and metals. The metal pieces would typically be made from a metal or some metal alloy, but could alternatively be made from other resilient materials, such as plastics, and other equivalent man-made materials.

For a user, it would be helpful to be able to adjust the operation of the light source by changing the orientation of the light source, and focus the light source by rotating the light source around its axis. In various embodiments, elimination of all buttons and switches would also have advantages.

Components

In various embodiments, the self-adaptable light source includes one or more of the following types of components. Table 1 provides a list of components for one embodiment of the invention as shown in the following figures, but alternative embodiments can have a subset of the following components or additional components.

TABLE 1

| | |
|---|---|
| Lantern Light 101 | In one embodiment this includes one or more LEDS controlled by pulse-width modulation (PWM) or voltage control. In one embodiment this is a wide area light. In one embodiment it may include reflectors or equivalents. |
| Head 102 and Body 103. | In one embodiment the head and body provide a plastic enclosure that has a top and bottom used to house all the electronics inside the product. |
| Digital Focus 201 | In one embodiment this adjusts the light between multiple flood light and beam states and intensities. |
| Cap Sense Body 202 | optional in various embodiments |
| Beam Light 205 | In one embodiment this includes one or more LEDs controlled by pulse-width modulation (PWM) or voltage control. |
| Flood Lights 206 | In one embodiment this includes one or more LEDs controlled by pulse-width modulation (PWM) or voltage control. |
| Soft-Switch 207 | optional in various embodiments |
| 1D, 2D, 3D Accelerometer 304 | optional in various embodiments |
| One or more batteries 306. | In one embodiment this can be one or more lithium polymer batteries 3.7V (But in alternative embodiments this can be any type of battery, e.g., lithium ion, lithium FE, nickel cadmium, nickel metal hydrate, lead acid, or any other electrochemical storage technology.) |
| Data Processor 305. | In one embodiment, it has analog to digital converters built-in to detect the voltage across the current detection circuit. In one embodiment the data processor (e.g., a microprocessor or micro-controller or equivalent) also has digital input and output ports to control the display graphics and buttons for user input. |
| Rubber cap 501 | Optional |
| Head enclosure 502 | Optional |
| Beam focus 503 | Optional |
| Printed Circuit Board 600 | Optional |

Various embodiments of the invention can be implemented on one or more substrates. One embodiment utilizes only one substrate. One embodiment utilizes a first substrate and a second substrate. One embodiment utilizes a first substrate, a second substrate, and a third substrate.

Various embodiments of the invention can utilize LEDs that, for example, are commercially available from the following manufacturers—Cree Inc., with corporate headquarters in Durham, N.C. (e.g., the Xlamp XT-E or equivalents); Lite-On Inc., with corporate headquarters in Milpitas, Calif. (e.g., the LTPL or equivalents); Philips Lumileds, with corporate headquarters in San Jose, Calif. (e.g., the Luxeon Z or equivalents).

Various embodiments of the invention can utilize a data processor, such as a micro-controller or microprocessor that is commercially available from the following manufacturers—Microchip Technology Inc., with corporate headquarters in Chandler, Ariz.; Cypress Semiconductor, with corporate headquarters in San Jose, Calif.; Texas Instruments, with corporate headquarters in Dallas, Tex. (e.g., the ARM9 or equivalents); Zilog, with corporate headquarters in Milpitas, Calif. (e.g., the Z180 or equivalents); and Freescale Semiconductor, with corporate headquarters in Austin, Tex. (e.g., the MPC83xx, or equivalents).

Various embodiments of the invention can utilize accelerometers that, for example, are commercially available from the following manufacturers—Bosch Sensortec, with corporate headquarters in Reutlingen, Kusterdingen, Germany (e.g., the BMA222 or equivalents); Kionix Inc., with corporate headquarters in Ithaca, N.Y. (e.g., the KXTC9 or equivalents); and Murata Electronics, with corporate headquarters in Kyoto, Japan (e.g., the SCA3060 or equivalents).

Various embodiments of the invention can utilize connectors that, for example, are commercially available from the following manufacturers—Molex Inc., with corporate headquarters in Lisle, Ill.; 3M Company, with corporate headquarters in Maplewood, Minn.; and Panasonic, with corporate headquarters in Osaka, Japan.

Various embodiments of the invention can utilize batteries that, for example, are commercially available from the following manufacturers—Dongguan Kanyo Battery Technology Co LTD., with corporate headquarters in Guangdong, China; and Unitech Battery Limited, with corporate headquarters in Shenzhen City, China.

In various embodiments, there is a user interface that allows the user to change operation of the light source by moving the light source in selected ways or by using a button. In various embodiments, the button can be a mechanical push button, switch, capacitive sense, or any equivalent type of human interface method to capture user input. In summary, various embodiments of the invention can lack any buttons, or include one or more of the following user interfaces (1) physical buttons, including soft or hard buttons, and (2) capacitive sense buttons or making the shell of the flashlight a capacitive sense button.

Various embodiments of the invention can have varying sizes of batteries, capacities, and battery technology types (e.g., lithium polymer, lithium ion, lithium FE, nickel cadmium, nickel metal hydrate, lead acid, or any other electrochemical storage technology). Various embodiments of the invention can have one or more outputs to charge one or more devices. In various embodiments, the data can be displayed by connecting by wireless or wire connectivity to smart-phones, tablet computers, personal computers (PCs), or equivalents. In one embodiment the data can be sent to a smart-phone app to view all the data. Various embodiments of the invention can thus use an external display instead of a display built into the product.

Various embodiments of the invention can have varying output voltages, for example 5.0 volts, 3.3 volts, etc. Various embodiments of the invention can have various output plugs (e.g., USB, FireWire and equivalents) and just not limited to USB male A. Various embodiments of the invention can have various input plugs to accommodate different formats of charging the battery of the self-adaptable light source. Various embodiments of the invention can have a rubber seal around the mating top and bottom of the enclosure to make the enclosure water tight, and water resistant.

Data Processor Calculations

Some embodiments of the invention can have a data processor (e.g., a microprocessor or a micro-controller or an equivalent) that will be able to determine at any given time the rate of current draw going in and out of the battery. Various embodiments of the invention with a higher sampling rate will give a more accurate calculation.

FIGS. 1 through 4 illustrate the novel features of the self-adaptable light source in various embodiments. The self-adaptable light source head 102 contains the physical lantern light 101 built into the head portion of the self-adaptable light source. In one embodiment, the lantern light 101 also has, but is not limited to, a convex, parabolic reflector which can be made of plastic or metal with a reflective surface. This reflective surface may have a mirror-like or textured surface.

FIG. 1 illustrates a basic self-adaptable light source, in accordance with one embodiment of the invention. FIG. 1 shows a self-adaptable light source comprising a lantern light 101, a head 102, a body 103, a digital focus 201 (which adjusts the light between multiple flood and beam states and intensities), a cap sense body 202, a soft-switch 207, an end cap 402, and a head enclosure 502.

Figure 2:
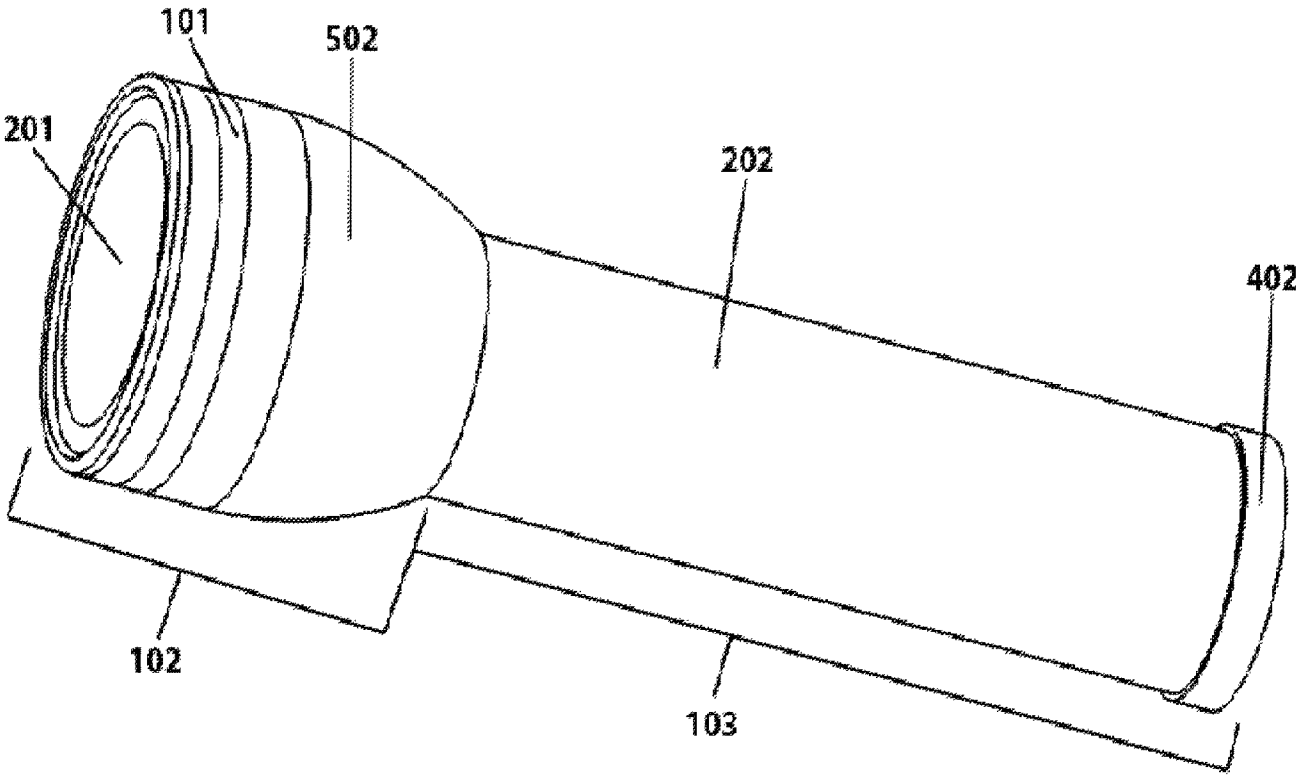
FIG. 2 illustrates an alternative self-adaptable light source, in accordance with one embodiment of the invention.

FIG. 2 illustrates an alternative self-adaptable light source, in accordance with one embodiment of the invention. FIG. 2 shows a self-adaptable light source comprising a lantern light 101, a head 102, a body 103, a digital focus 201 (which adjusts the light between multiple flood and beam states and intensities), a cap sense body 202, an end cap 402, and a head enclosure 502.

Figure 3:
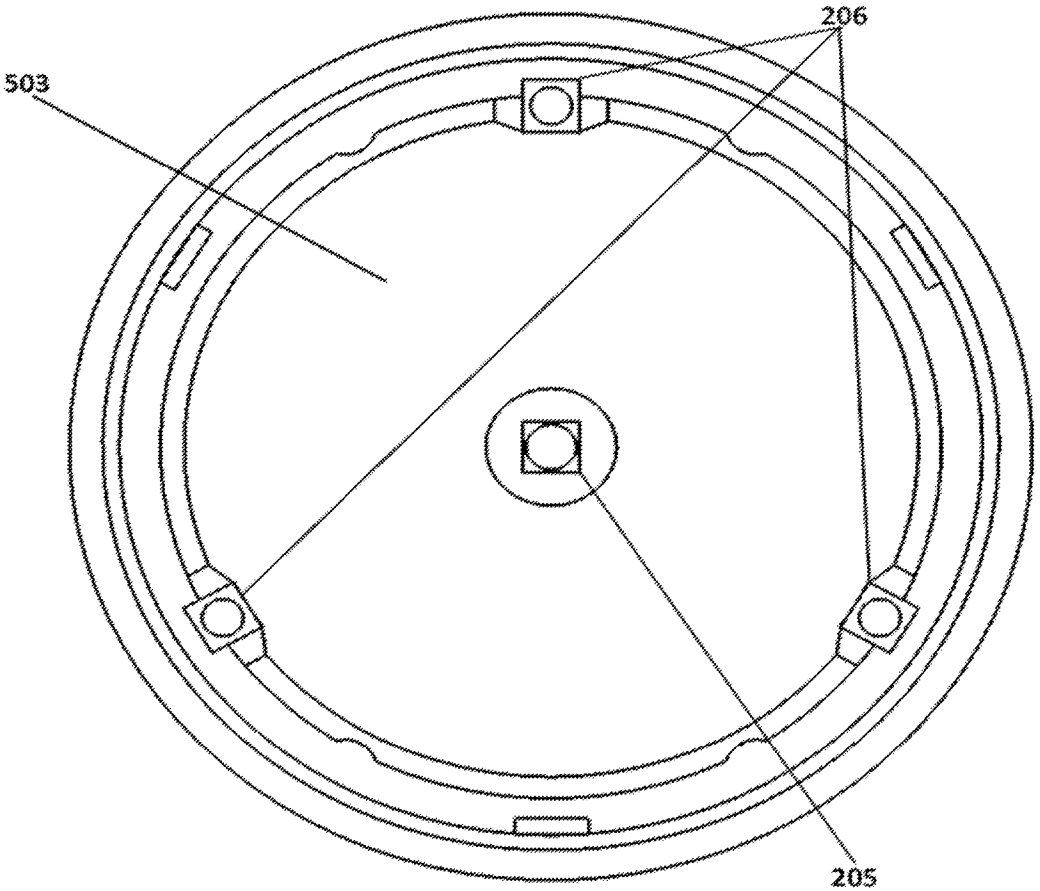
FIG. 3 illustrates a front view of a self-adaptable light source, in accordance with one embodiment of the invention.

FIG. 3 illustrates a front view of a self-adaptable light source, in accordance with one embodiment of the invention. FIG. 3 shows a beam focus 503, a beam light 205 and three flood lights 206. In another embodiment, it could be one or more flood lights 206.

In one embodiment, the beam light 205, flood light 206, and lantern light 101 use LEDs 204 controlled by pulse-width modulation (PWM) or voltage control to adjust the light of the light source. In one embodiment, the digital focus 201 adjusts the light between multiple flood and beam states by blending the beam light 205 with the flood light 206 using pulse-width modulation (PWM) or voltage control, or an equivalent control.

Figure 4A:
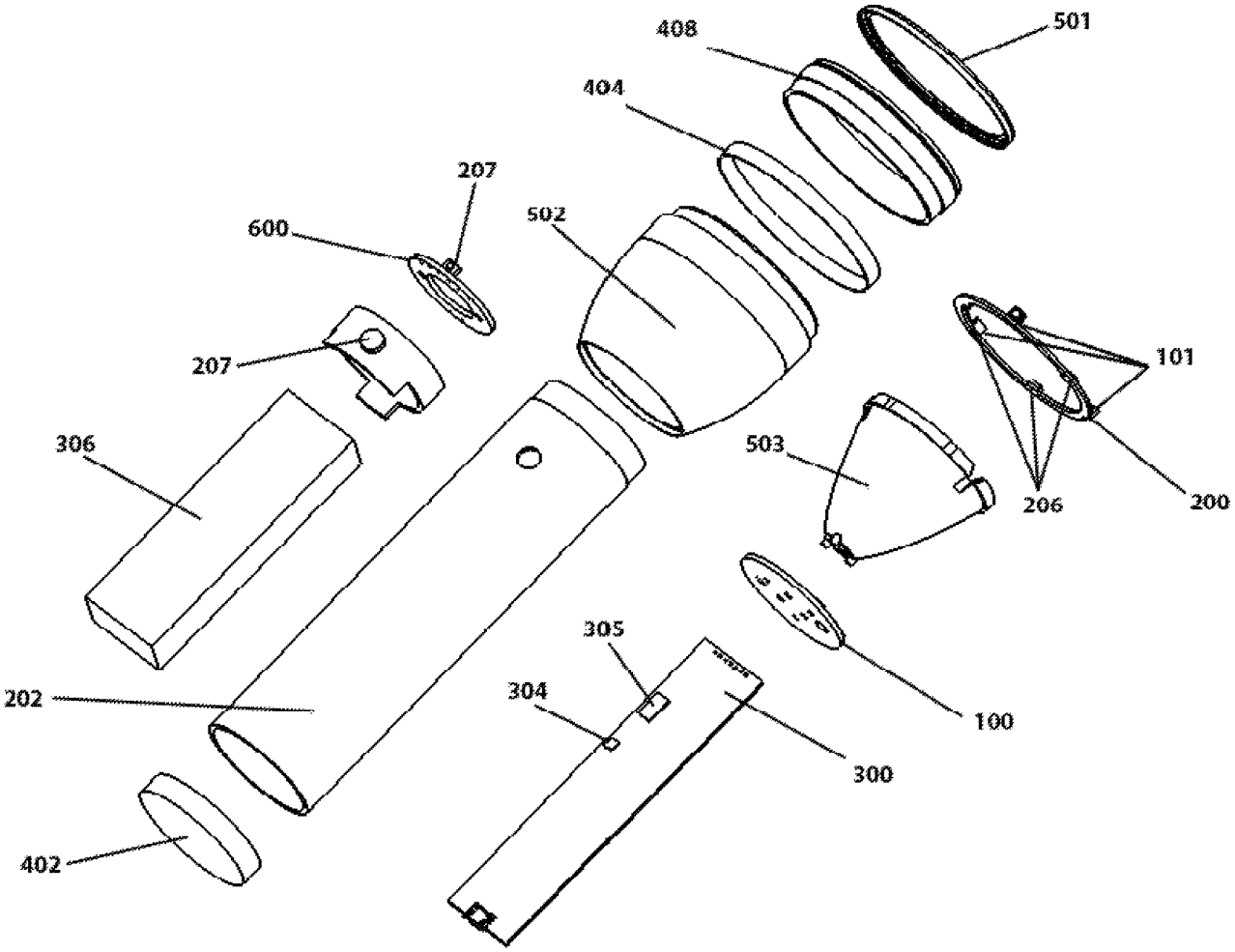
FIG. 4A illustrates an exploded isometric view of a self-adaptable light source, in accordance with one embodiment of the invention.

FIG. 4A illustrates an exploded isometric view of a self-adaptable light source, in accordance with one embodiment of the invention. FIG. 4A shows a self-adaptable light source comprising a first substrate 100, an optional second substrate 200, a lantern light 101, a head 102, a body 103, a cap sense body 202, a plurality of dimmable LEDs (where in various embodiments the LEDs are brightened or dimmed by pulse-width modulation (PWM) or voltage control, or by equivalent methods) to implement a beam light 205 and a flood light 206, an optional third substrate 300, one 1D, 2D, 3D accelerometer 304, a data processor 305, and a battery with charger circuit 306 (e.g., a lithium polymer battery or equivalent). In addition, in this embodiment there are also an end cap 402, a decorative ring 404, a head cap 408, a rubber cap 501, a head enclosure 502, a beam focus 503, and an optional substrate 600 with a soft-switch 207.

Figure 4B:
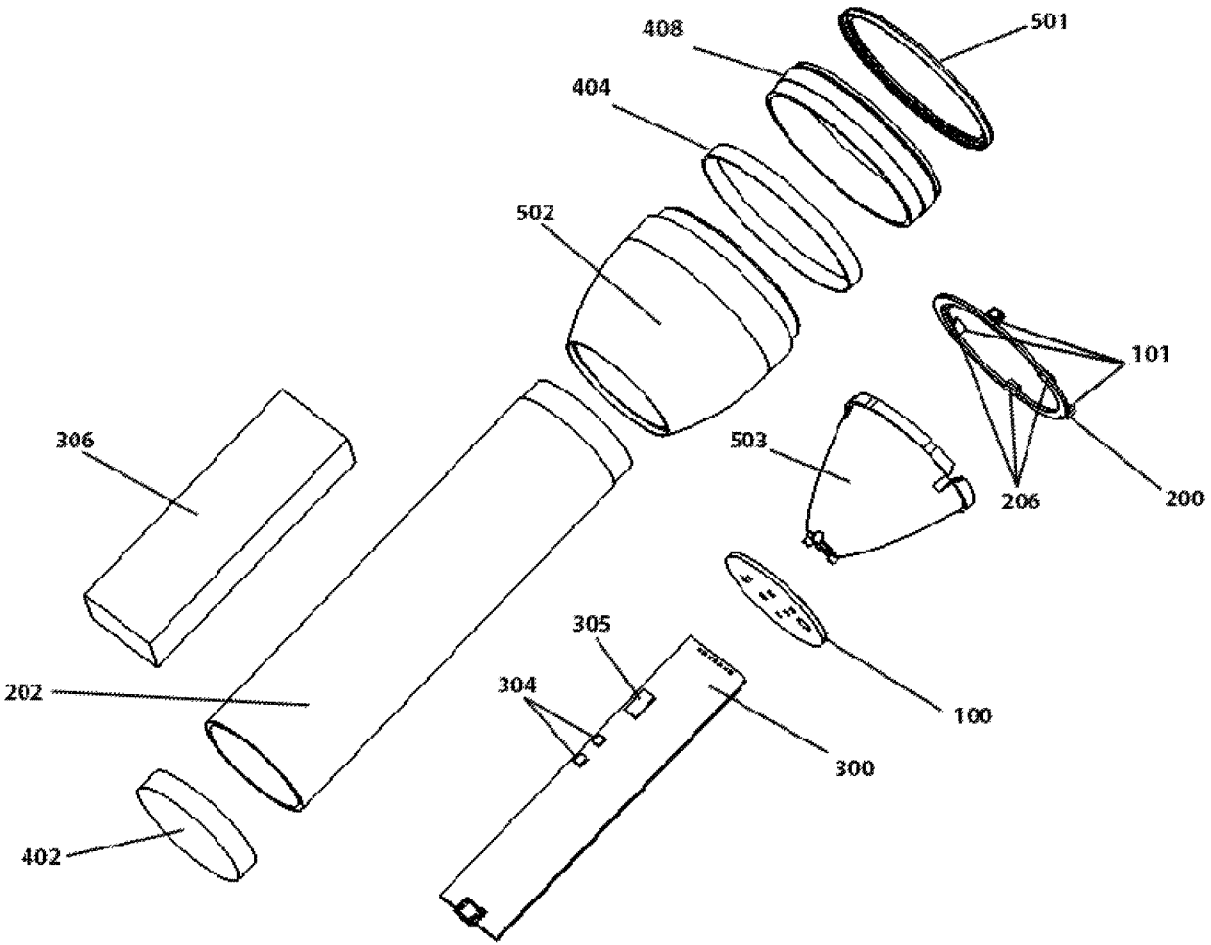
FIG. 4B illustrates an exploded isometric view of a self-adaptable light source, in accordance with one embodiment of the invention.

FIG. 4B illustrates an exploded isometric view of a self-adaptable light source, in accordance with one embodiment of the invention. FIG. 4B shows a self-adaptable light source comprising a first substrate 100, an optional second substrate 200, a lantern light 101, a head 102, a body 103, a cap sense body 202, a plurality of dimmable LEDs (where in various embodiments the LEDs are controlled by pulse-width modulation (PWM) or voltage control) to implement a beam light 205 and a flood light 206, an optional third substrate 300, two 1D, 2D, 3D accelerometers 304, a data processor 305, and a battery with charger circuit 306 (e.g., a lithium polymer battery, lithium ion battery, or an equivalent). In addition, in this embodiment there are also an end cap 402, a decorative ring 404, a head cap 408, a rubber cap 501, a head enclosure 502, and a beam focus 503.

In one embodiment, the cap sense body 202 uses capacitive sense technology to sense when the user is holding the self-adaptable light source. In one embodiment, the soft-switch 207 turns the self-adaptable light source on to the last setting. When the self-adaptable light source is on, a quick press of the soft-switch 207 disables/enables optional cap sense interface buttons (not shown), while a press and hold of the soft-switch 207 turns the self-adaptable light source off. In one embodiment, while one or more optional cap sense interface buttons are enabled, the user may use these buttons to toggle between beam light 205, flood light 206, and lantern light 101 modes, focus the light, and adjust light intensity. In one embodiment, if the user is holding the self-adaptable light source and has the beam light 205 and or flood light 206 on and then stops touching the cap sense body 202, the beam light 205 and or flood light 206 will fade off while the lantern light 101 fades in simultaneously.

The battery (e.g., a lithium polymer battery or lithium ion battery, or an equivalent battery) with charger circuit 306 is rechargeable and is used to power the LEDs, accelerometer(s), and the data processor 305.

In one embodiment, the 1D, 2D, 3D accelerometer(s) 304 detects user movements or gestures, and detects the position and orientation of the self-adaptable light source to control the light intensity, focus, and mode. In one embodiment, having at least two accelerometers 304 allows the data processor 305 to determine the preferences of the user without requiring the user to activate any button or switches, so such buttons or switches would not be necessary on the surface of the light source. In various embodiments, examples of commands dictated by movements and gestures may include, but are not limited to, the following:

1. "Casting" or throwing motion to quickly switch to 100% beam light 205 or back to lantern light 101.
2. Vertical tap to switch to lantern light 101 or switch back to beam light 205.
3. Rotating the light source up or down at various angles to adjust the light.
4. Rotating the light source around one of its major axes (e.g., the long axis of a flashlight, or an equivalent) to indicate that the user wants to focus the light. This type of rotational motion focusing will be called a virtual focus.
5. Press and hold a cap sense interface and change the angle of the self-adaptable light source to the ground to control the digital focus 201.

The data processor 305 processes inputs from the cap sense body 202, cap sense interface buttons 203 and accelerometer(s) 304 and controls the LEDs 204 accordingly. The data processor 305 is also programmed to learn user preferences in one embodiment.

In one embodiment the self-adaptable light source has a head 102 and body 103 used to house all the electronics inside the product. In one embodiment there could be a connector (e.g., a USB Male A connector) used to plug in a USB cable to the self-adaptable light source. In one embodiment this connector outputs 5 volts DC. In one embodiment the connector could be a mini USB or round power plug used to connect 18 volts DC to 5 volts DC to charge the battery (e.g., lithium battery or equivalent chemical storage).

The substrate 300 (e.g., a printed circuit board, or equivalent) is used to mount electronic components. The one or more batteries 306 in one embodiment can be one or more 3.7 volt lithium polymer batteries (but in alternative embodiments the batteries can be any type of battery). The battery and charger circuit 306 can regulate the incoming voltage (e.g., 110 V, 18V, 5V, or other voltage) to charge the one or more batteries (e.g., one or more lithium batteries, or equivalent batteries).

In one embodiment the data processor 305 has digital input and output ports (not shown) to control the light source and optional buttons for user input.

In one embodiment, the one or more optional buttons (not shown) can be push buttons or capacitive sense touch buttons. In one embodiment a button can be used to toggle the operation and turn on and off the self-adaptable light source.

Figure 5:
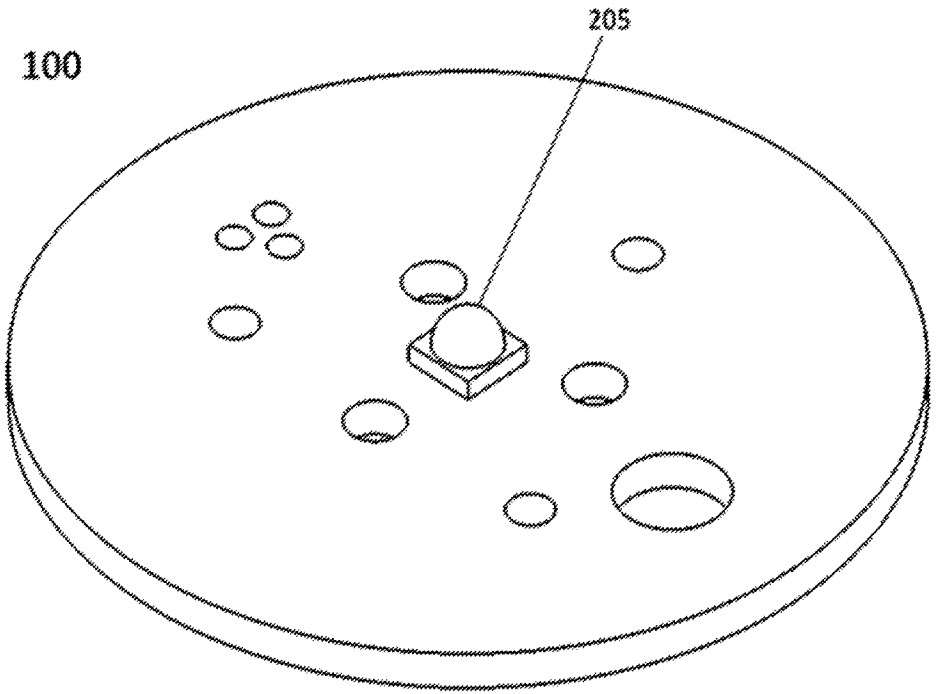
FIG. 5 illustrates a top view of one substrate in a self-adaptable light source, in accordance with one embodiment of the invention.

FIG. 5 illustrates a top isometric view of a substrate of a self-adaptable light source, in accordance with one embodiment of the invention. FIG. 5 shows a beam light 205 on a first substrate 100. In another embodiment, there would additionally be one or more flood lights (not shown) on the first substrate 100.

Figure 6:
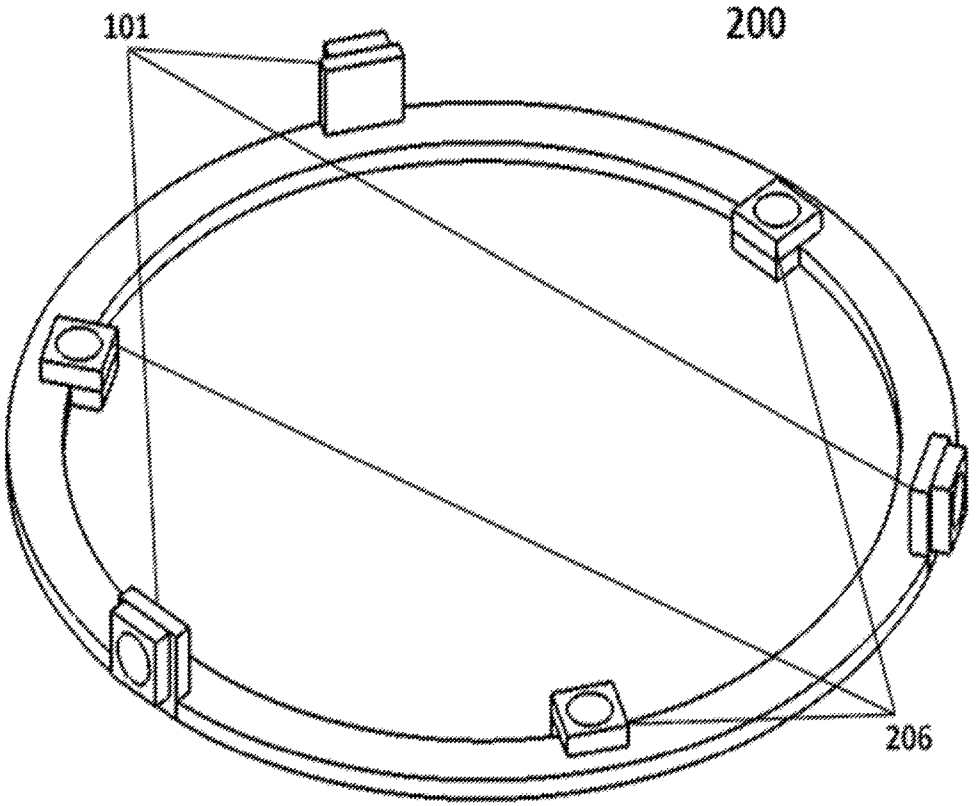
FIG. 6 illustrates a top view of an optional second substrate in a self-adaptable light source, in accordance with one embodiment of the invention.

FIG. 6 illustrates a top isometric view of an optional second substrate of a self-adaptable light source, in accordance with one embodiment of the invention. FIG. 6 shows three lantern lights 101 and three flood lights 206 on an optional second substrate 200. Other embodiments would have more or less lantern lights 101 and flood lights 206.

Figure 7A:
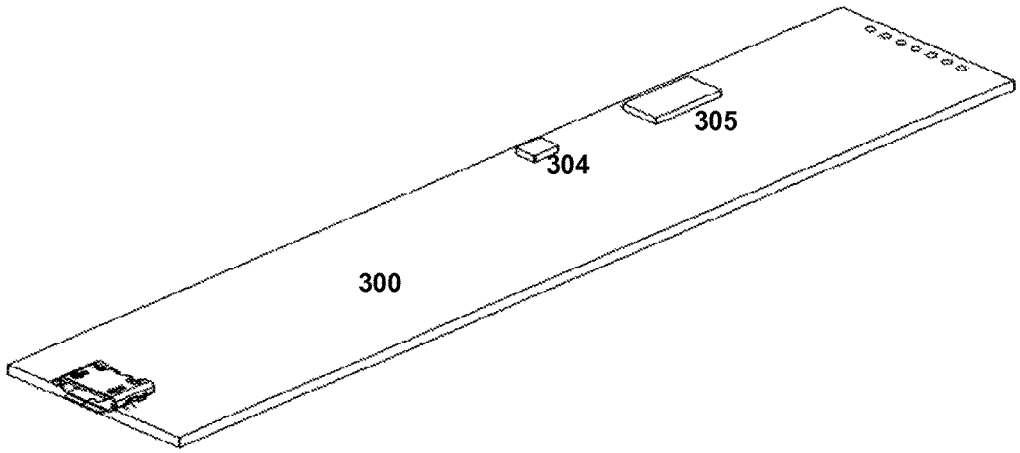
FIG. 7A illustrates an isometric view of a substrate in a self-adaptable light source, in accordance with one embodiment of the invention.

FIG. 7A illustrates an isometric top view of an optional third substrate of a self-adaptable light source, in accordance with one embodiment of the invention. FIG. 7A shows an optional third substrate 300, a 1D, 2D, 3D accelerometer 304, and a data processor 305. This is only one illustrative example of such a substrate, because other embodiments of this substrate could be implemented without certain components.

Figure 7B:
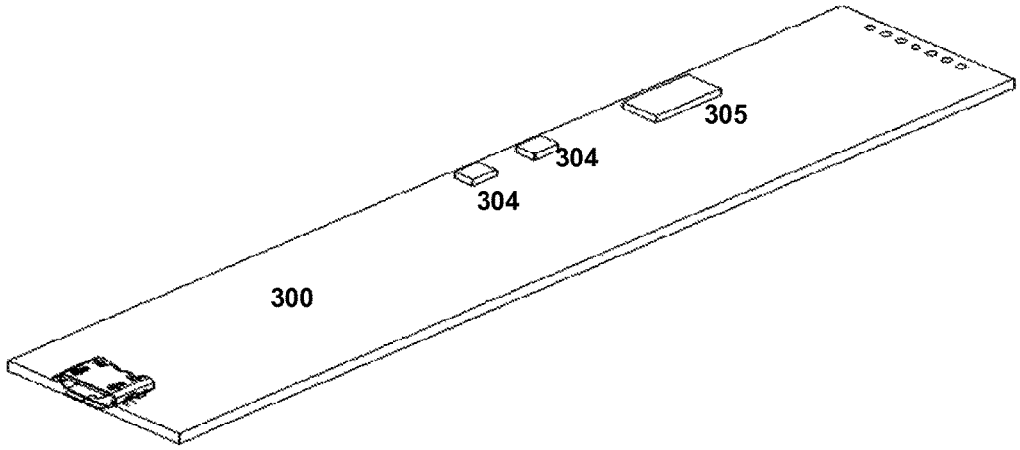
FIG. 7B illustrates an isometric view of a substrate in a self-adaptable light source, in accordance with one embodiment of the invention.

FIG. 7B illustrates an isometric top view of an optional third substrate of a self-adaptable light source, in accordance with one embodiment of the invention. FIG. 7B shows an optional third substrate 300, two 1D, 2D, 3D accelerometers 304, and a data processor 305. This is only one illustrative example of such a substrate, because other embodiments of this substrate could be implemented without certain components.

Figure 8A:
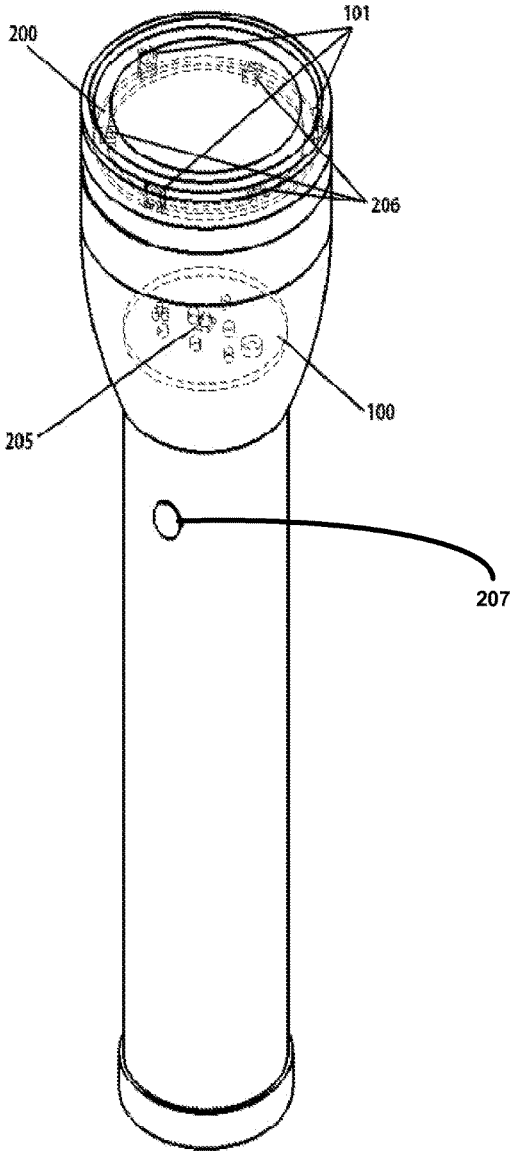
FIG. 8A illustrates an isometric top view of an optional third substrate of a self-adaptable light source, in accordance with one embodiment of the invention.

FIG. 8A illustrates a side view of a self-adaptable light source, in accordance with one embodiment of the invention. FIG. 8A shows a beam light 205 on a first substrate 100, and three lantern lights 101 and three flood lights 206 on an optional second substrate 200. A soft switch 207 is shown.

Figure 8B:
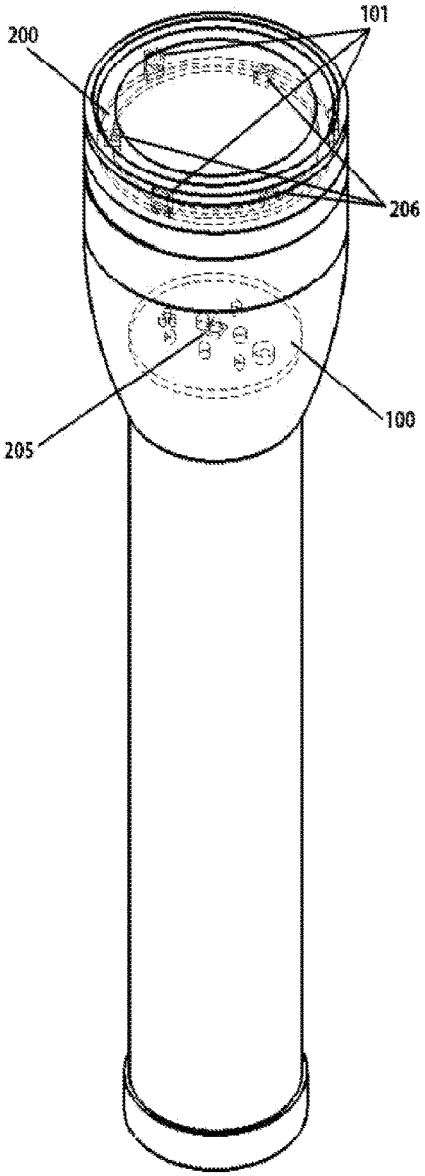
FIG. 8B illustrates a side view of a self-adaptable light source, in accordance with one embodiment of the invention.

FIG. 8B illustrates a side view of a self-adaptable light source, in accordance with one embodiment of the invention. FIG. 8B shows a beam light 205 on a first substrate 100, and three lantern lights 101 and three flood lights 206 on an optional second substrate 200. A soft switch 207 is not needed in this embodiment.

Figure 9:
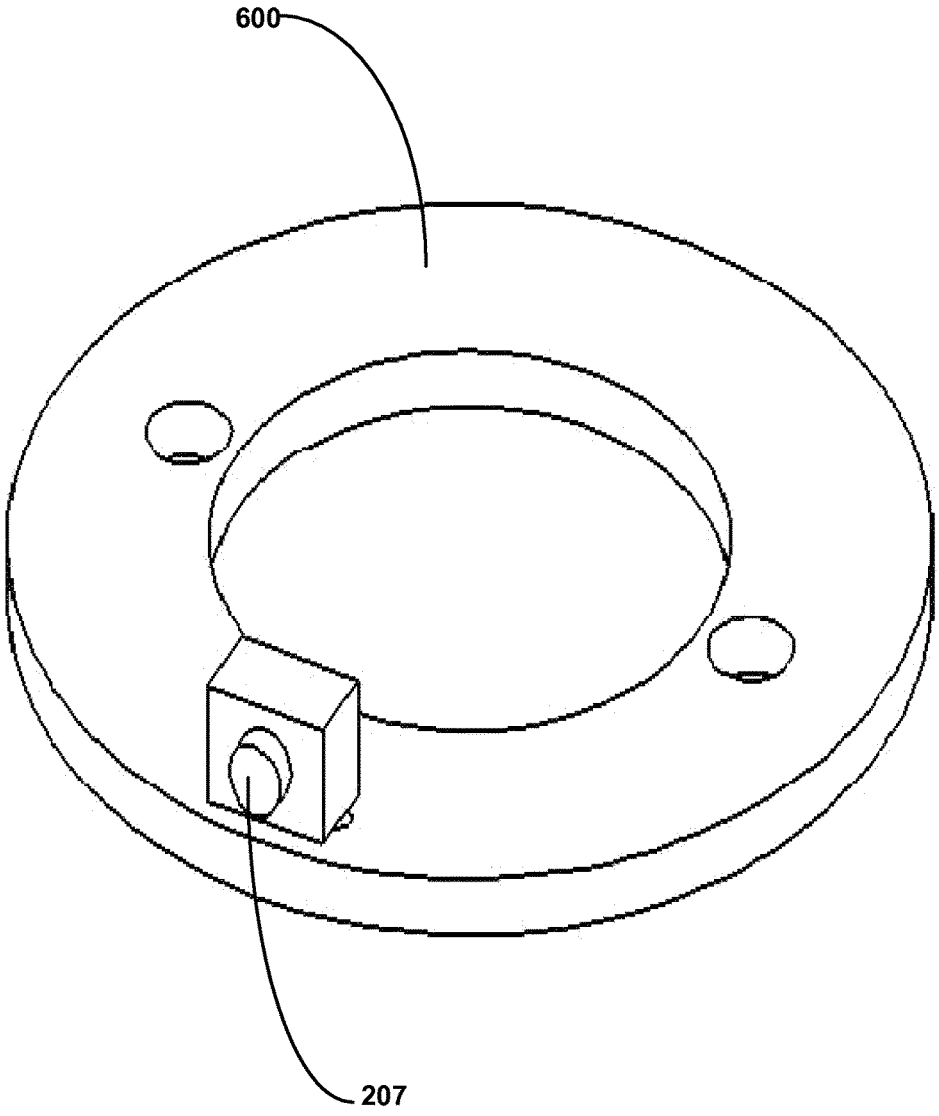
FIG. 9 illustrates a substrate with soft switches, in accordance with one embodiment of the invention.

FIG. 9 illustrates a substrate with one soft-switch, in accordance with one embodiment of the invention. FIG. 9 shows a printed circuit board 600 with a soft-switch 207. In another embodiment there would be another substrate material used for making the board 600.

Figures 10A, 10B:
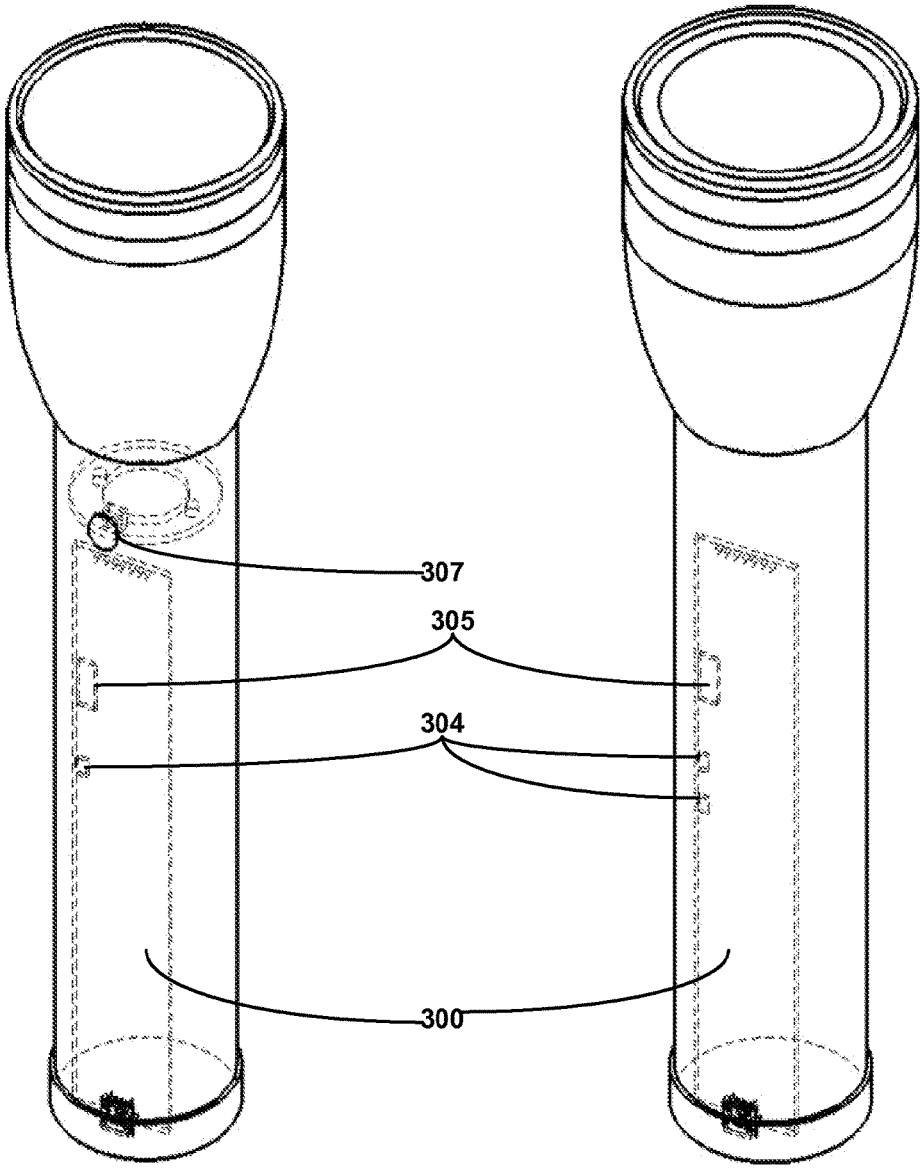
FIG. 10A illustrates a side view of a self-adaptable light source with a soft switch, in accordance with one embodiment of the invention.
FIG. 10B illustrates a side view of a self-adaptable light source without a soft switch, in accordance with one embodiment of the invention.

FIG. 10A illustrates a side view of a self-adaptable light source with a soft switch, in accordance with one embodiment of the invention. FIG. 10A shows a soft-switch 207, an optional third substrate 300, a 1D, 2D, 3D accelerometer 304, and a data processor 305. This is only one illustrative example of such a substrate, because other embodiments of this substrate could be implemented without certain components, or additional components.

FIG. 10B illustrates a side view of a self-adaptable light source without a soft switch, in accordance with one embodiment of the invention. FIG. 10B shows an optional third substrate 300, two 1D, 2D, 3D accelerometers 304, and a data processor 305. This is only one illustrative example of such a substrate, because other embodiments of this substrate could be implemented without certain components, or additional components.

Figure 11:
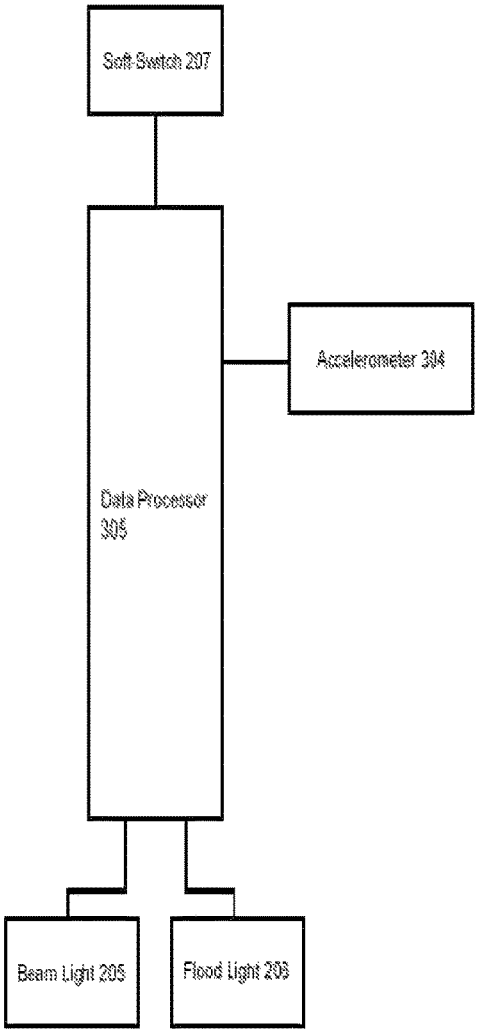
FIG. 11 illustrates the components of an implementation using a soft switch, in accordance with one embodiment of the invention.

FIG. 11 illustrates the components of an implementation with a soft switch, in accordance with one embodiment of the invention. FIG. 11 shows a data processor 305 (e.g., microcontroller, microprocessor, CPU, programmable system on a chip, or equivalent), which is electrically coupled to a soft-switch 207, one or more beam light(s) 205, one or more flood light(s) 206, and an accelerometer (e.g., a 1D, 2D, 3D accelerometer). This is only one illustrative example, because other embodiments could be implemented without certain components, or additional components.

Figure 12:
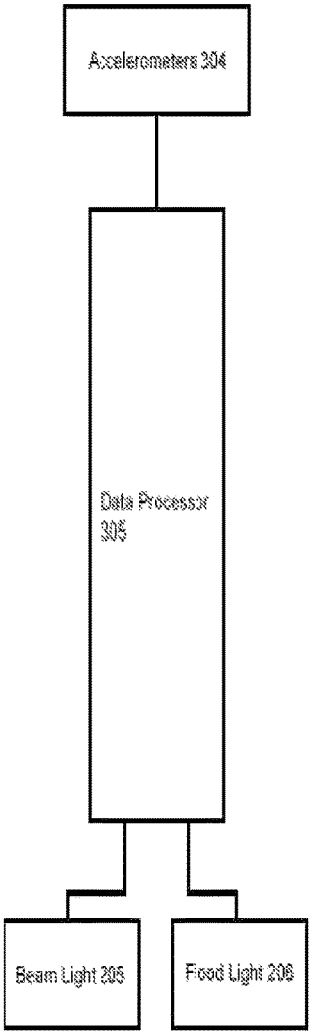
FIG. 12 illustrates the components of an implementation without a soft switch, in accordance with one embodiment of the invention.

FIG. 12 illustrates the components of an implementation without a soft switch, in accordance with one embodiment of the invention. FIG. 12 shows a data processor 305 (e.g., microcontroller, microprocessor, CPU, programmable system on a chip, or equivalent), which is electrically coupled to one or more beam light(s) 205, one or more flood light(s) 206, and two or more accelerometers (e.g., 1D, 2D, 3D accelerometers). This is only one illustrative example, because other embodiments could be implemented without certain components, or additional components.

Figure 13A:
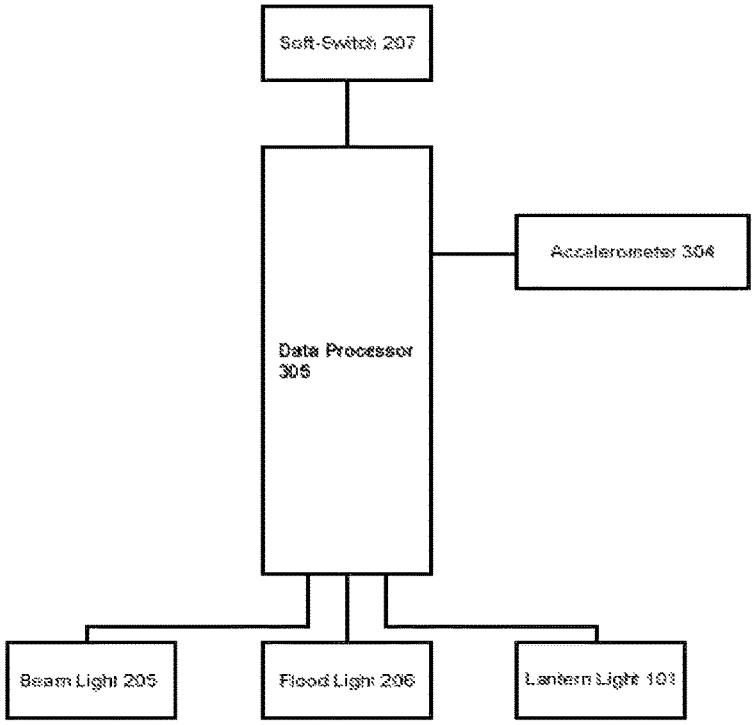
FIG. 13A illustrates the components of an implementation with a soft switch, in accordance with one embodiment of the invention.

FIG. 13A illustrates the components of an implementation with a soft switch, in accordance with one embodiment of the invention. FIG. 13A shows a data processor 305 (e.g., microcontroller, microprocessor, CPU, programmable system on a chip, or equivalent), which is electrically coupled to one or more soft-switches 207, one or more beam light(s) 205, one or more flood light(s) 206, one or more lantern light(s) 101, and an accelerometer (e.g., a 1D, 2D, 3D accelerometer). This is only one illustrative example, because other embodiments could be implemented without certain components, or implemented with additional components.

Figure 13B:
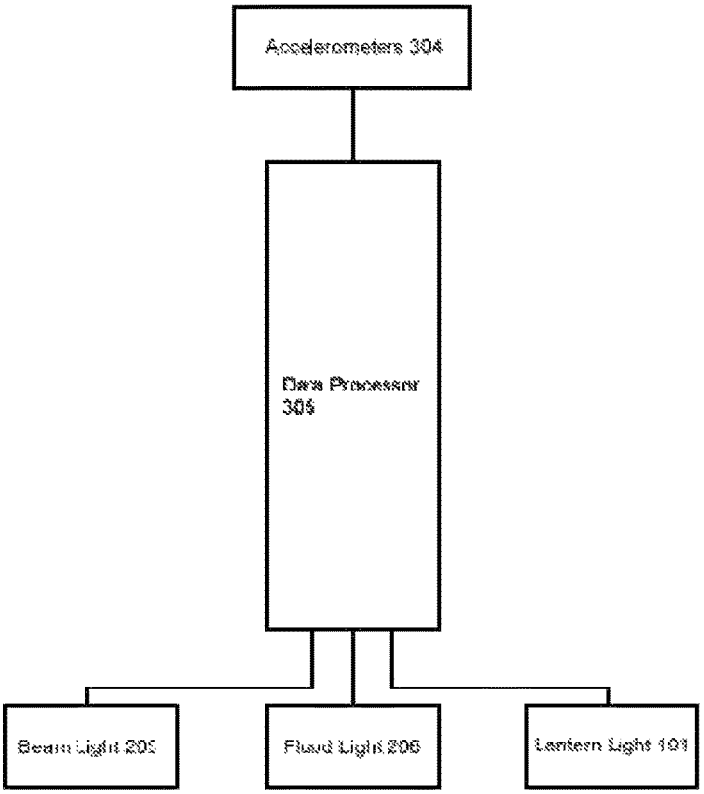
FIG. 13B illustrates the components of an implementation without a soft switch, in accordance with one embodiment of the invention.

FIG. 13B illustrates the components of an implementation without a soft switch, in accordance with one embodiment of the invention. FIG. 13B shows a data processor 305 (e.g., microcontroller, microprocessor, CPU, programmable system on a chip, or equivalent), which is electrically coupled to one or more beam light(s) 205, one or more flood light(s) 206, one or more lantern light(s) 101, and two or more accelerometers (e.g., 1D, 2D, 3D accelerometers). This is only one illustrative example, because other embodiments could be implemented without certain components (e.g., without buttons), or implemented with additional components.

Figure 14:
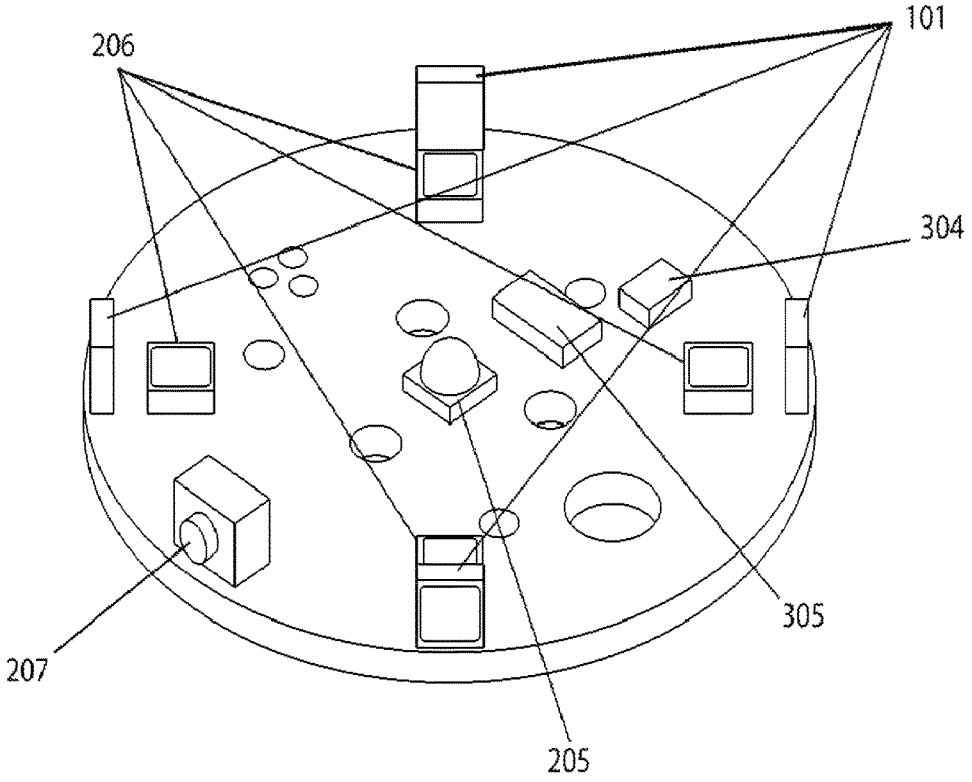
FIG. 14 illustrates a single substrate with components, in accordance with one embodiment of the invention.

FIG. 14 illustrates the components of a single substrate implementation, in accordance with one embodiment of the invention. FIG. 14 shows a data processor 305 (e.g., microcontroller, microprocessor, CPU, programmable system on a chip, or equivalent), which is electrically coupled to one or more soft-switches 207, one or more lantern light(s) 101, one or more beam light(s) 205, one or more flood light(s) 206, and an accelerometer (e.g., a 1D, 2D, 3D accelerometer). This is only one illustrative example, because other embodiments could be implemented without certain components, or additional components.

Figure 15:
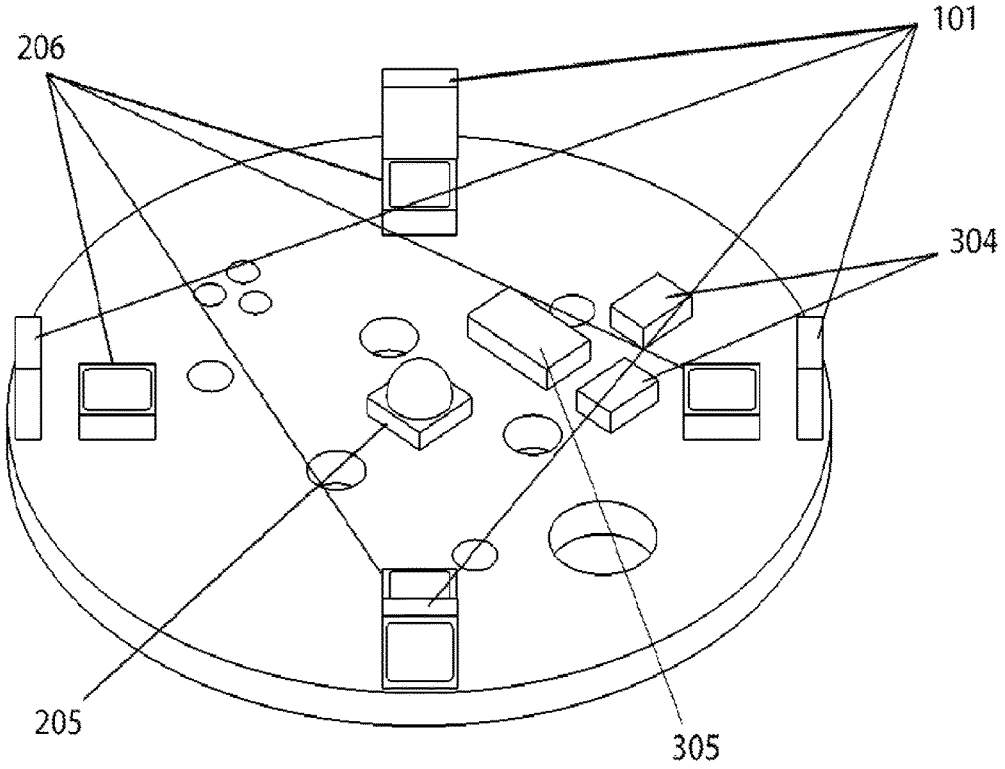
FIG. 15 illustrates a single substrate with components, in accordance with one embodiment of the invention.

FIG. 15 illustrates the components of a single substrate implementation, in accordance with one embodiment of the invention. FIG. 15 shows a data processor 305 (e.g., microcontroller, microprocessor, CPU, programmable system on a chip, or equivalent), which is electrically coupled to one or more lantern light(s) 101, one or more beam light(s) 205, one or more flood light(s) 206, and two or more accelerometers (e.g., 1D, 2D, 3D accelerometers). This is only one illustrative example, because other embodiments could be implemented without certain components, or additional components.

In one embodiment, the electricity is carried by one wire or trace, and the electrical ground is carried by two wires or traces. In another embodiment, simply two wires or trace (one wire or trace for the electricity and one wire or trace for ground) are used. In alternative embodiments more electrical wires or traces can be used. In one embodiment, there is a controller module that has an on-off switch and a charger port for charging a plurality of internal batteries.

The energy source in various embodiments can be one or more batteries, a photovoltaic electrical module, an electrical recharger, or some other equivalent electrical energy source with a capacity for supplying an appropriate amount of voltage and current. One embodiment of the invention uses one or more electrochemical batteries (e.g., lithium polymer batteries, lithium ion batteries, typically rated at 3.6 volts under normal conditions and 4.2 volts when fully charged, or other equivalent electrochemical batteries, either single charge or rechargeable, or other equivalent power sources). Most of the electrical power provided by such batteries will be used for supply power to operate electronics, and to operate the data processor.

Figure 16:
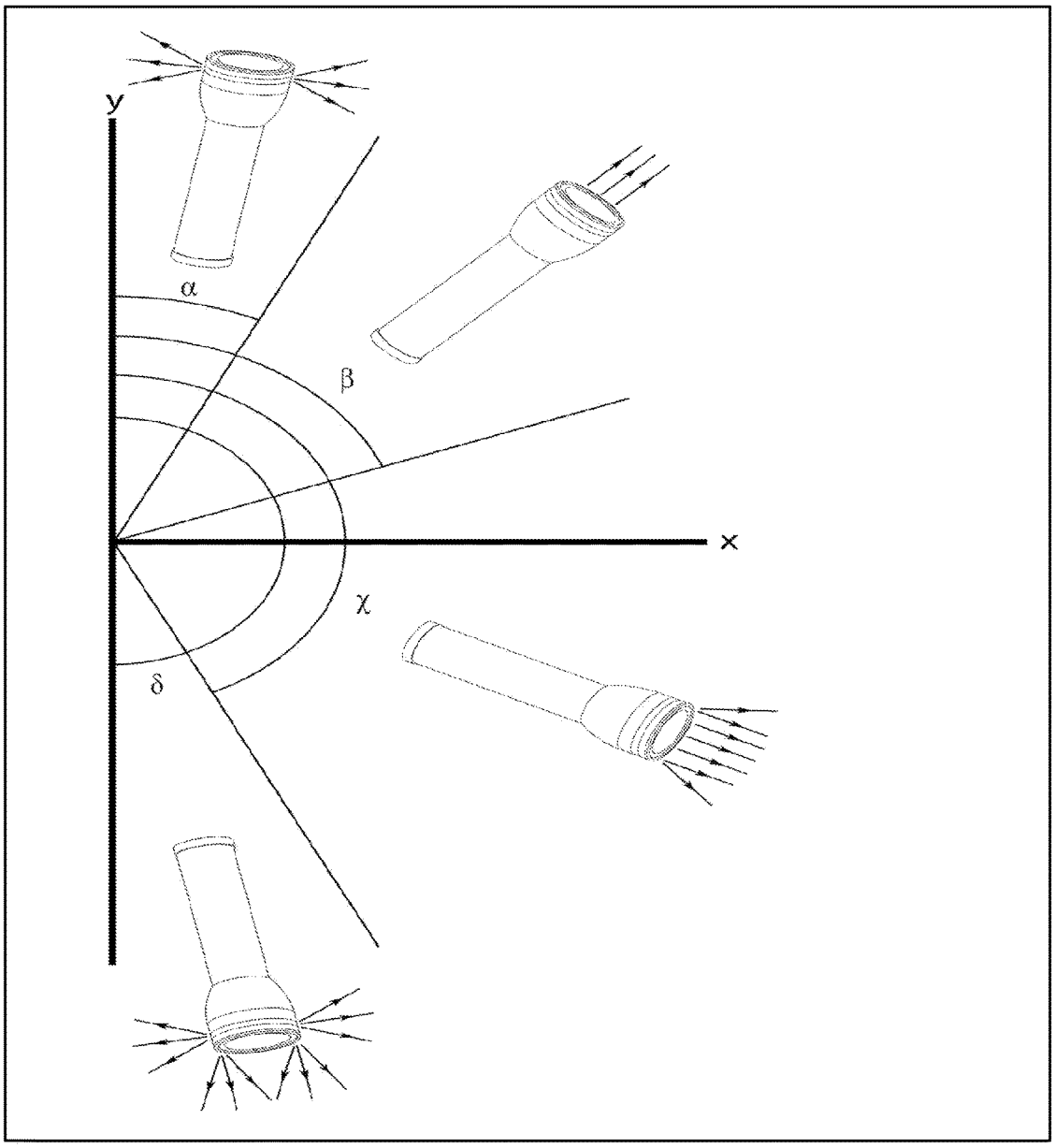
FIG. 16 illustrates some different modes of operation for a self-adaptable light source, in accordance with one embodiment of the invention.

FIG. 16 illustrates the different operations of the self-adaptable light source, in accordance with one embodiment of the invention. FIG. 16 shows a first mode of operation (lantern light only) for orientations of the self-adaptable light source for an angle from zero to alpha degrees. Alpha degrees is the threshold for the operation of the self-adaptable light source to change to a second mode of operation (beam light only) up to a angle of orientation of beta degrees. Between alpha and beta degrees the operation of the self-adaptable light source is in a second mode of operation (beam lights only) up to an angle of orientation of beta degrees. Between beta degrees and gamma degrees is another mode of operation (combination of beam light and flood light) up to an angle of gamma degrees. For any angle over gamma degrees up to delta degrees is another mode of operation (combination of lantern light and flood light). This is only one illustrative example, because other embodiments could have different angles and different selective activations and combinations of lantern lights, beam lights, and flood lights.

Figure 17:
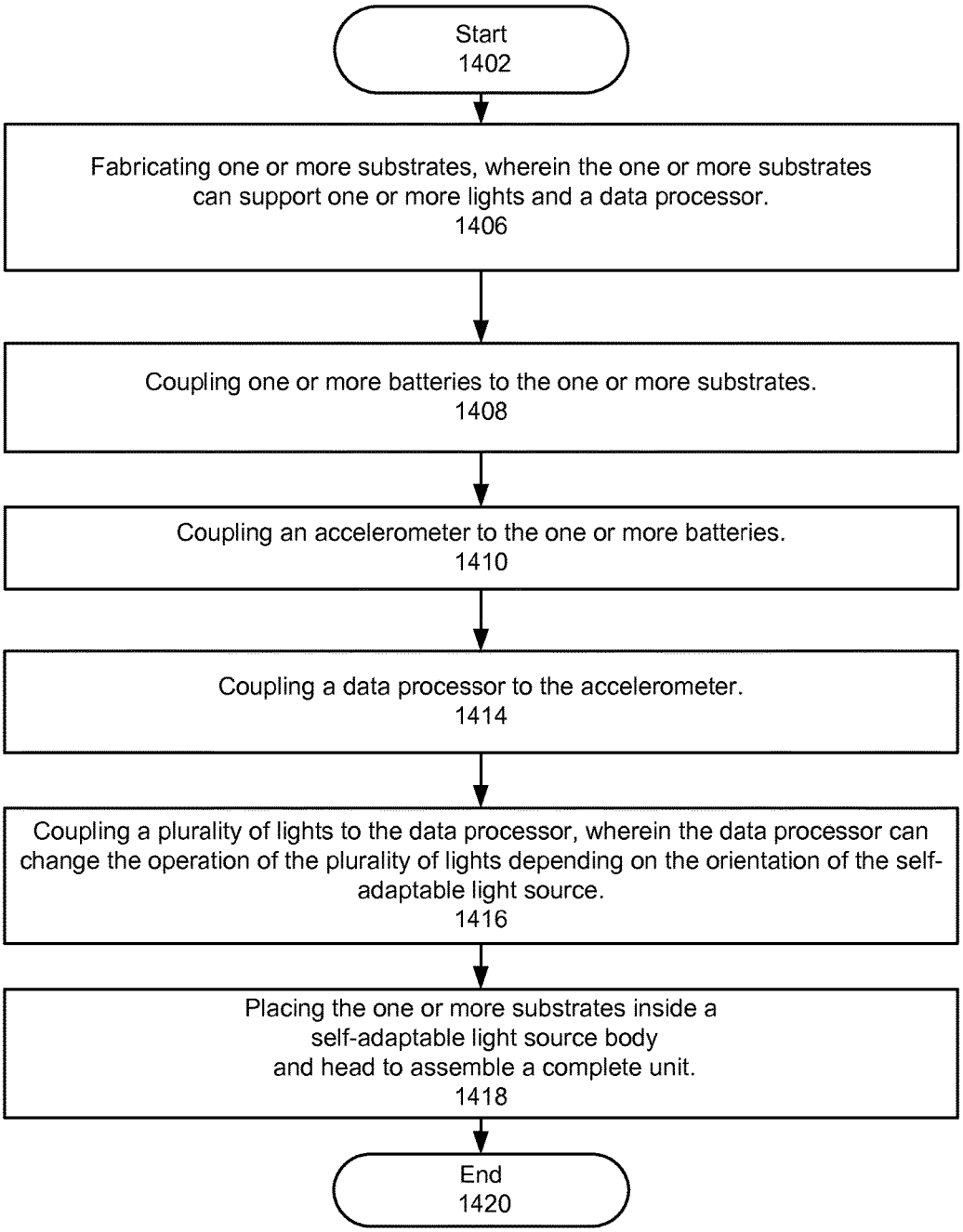
FIG. 17 illustrates a flowchart to make a self-adaptable light source, in accordance with one embodiment of the invention.

FIG. 17 illustrates a flowchart to make a self-adaptable light source, in accordance with one embodiment of the invention. The method starts in operation 1402. Operation 1406 is next and includes fabricating one or more substrates, wherein the one or more substrates can support one or more lights and a data processor. Alternative embodiments can use only one or two or three substrates. Operation 1408 is next and includes coupling one or more batteries to the one or more substrates. Operation 1410 is next and includes coupling an accelerometer to the one or more batteries. Operation 1414 is next and includes coupling the data processor to the accelerometer. Operation 1416 is next and includes coupling a plurality of lights to the data processor, wherein the data processor can change the operation of the plurality of lights depending on the orientation of the self-adaptable light source. Operation 1418 is next and includes placing the one or more substrates inside a self-adaptable light source body and head to assemble a complete unit. The method ends in operation 1420.

Figure 18:
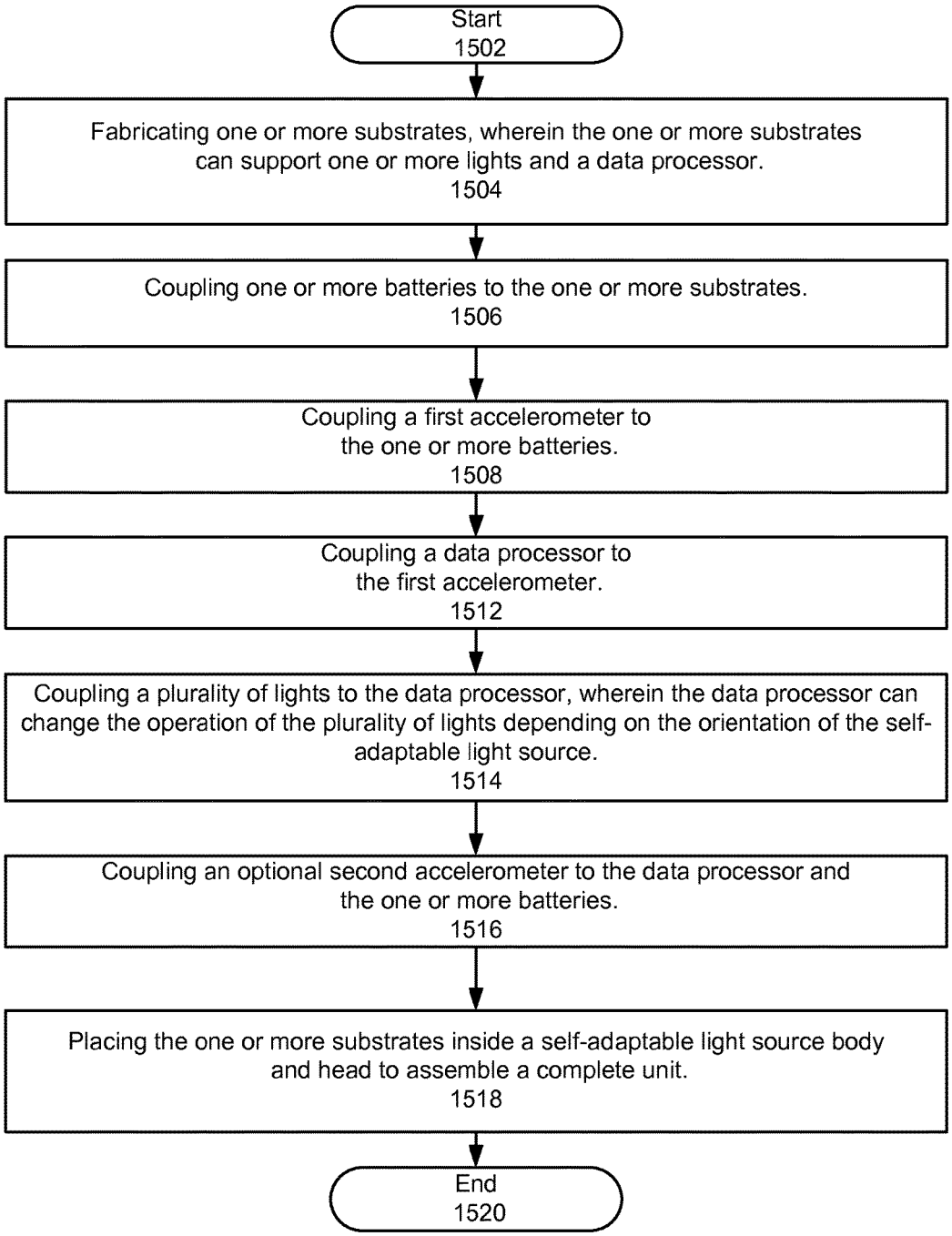
FIG. 18 illustrates a flowchart to make a self-adaptable light source, in accordance with one embodiment of the invention.

FIG. 18 illustrates a flowchart to make a self-adaptable light source, in accordance with another embodiment of the invention. The method starts in operation 1502. Operation 1504 is next and includes fabricating one or more substrates, wherein the one or more substrates can support one or more lights and a data processor. Alternative embodiments can use only one or two or three substrates. Operation 1506 is next and includes coupling one or more batteries to the one or more substrates. Operation 1508 is next and includes coupling a first accelerometer to the one or more batteries. Operation 1512 is next and includes coupling a data processor to the first accelerometer. Operation 1514 is next and includes coupling a plurality of lights to the data processor, wherein the data processor can change the operation of the plurality of lights depending on the orientation of the self-adaptable light source. Operation 1516 is next and includes coupling an optional second accelerometer to the data processor and the one or more batteries. Operation 1518 is next and includes placing the one or more substrates inside a self-adaptable light source body and head to assemble a complete unit. The method ends in operation 1520.

Other embodiments of the invention are possible. For example, the self-adaptable light source could be composed of several laminations of various materials for different applications. Another embodiment of the invention could provide multiple adjustable connectors to accommodate different sizes and lengths of electronics, energy sources, and cords.

The exemplary embodiments described herein are for purposes of illustration and are not intended to be limiting. Therefore, those skilled in the art will recognize that other embodiments could be practiced without departing from the scope and spirit of the claims set forth below.

What is claimed is:

1. A method to make a self-adaptable light source, comprising:

providing a self-adaptable light source body and a head connected to the self-adaptable light source body, fabricating one or more substrates, wherein the one or more substrates support a plurality of one or more dimmable lights comprising flood lights and a beam light and a data processor;

coupling one or more batteries to the one or more substrates;

coupling an accelerometer to the one or more batteries;

coupling the data processor to the accelerometer;

coupling the plurality of dimmable lights to the data processor to selectively provide a beam light state from the beam light and a flood light state from the flood lights by using one or more dimmable light emitting diodes for the flood lights and the beam light, disposing the beam light and the one or more batteries to a first substrate of the one or more substrates within the light source body;

disposing the flood lights to a second substrate of the one or more substrates within the head, wherein a digital focus of light is selectively provided and adjusted by blending the beam light state of the beam light with the flood light state of the flood light using pulse-width modulation or voltage control of the one or more dimmable light emitting diodes by the data processor, based on a two dimensional position and orientation state of the self-adaptable light source detected by the accelerometer and determined by the data processor where the data processor changes the digital focus of the light provided by the plurality of dimmable lights depending on the rotation of the self-adaptable light source;

placing the one or more substrates inside the self-adaptable light source body and the head to assemble a complete self-adaptable light source unit.

2. The method of claim 1, further including coupling a second accelerometer to the data processor.

3. The method of claim 1, wherein the data processor is a microprocessor or a micro-controller.

4. The method of claim 1, wherein coupling an accelerometer includes coupling a 1D accelerometer.

5. The method of claim 1, wherein coupling an accelerometer includes coupling a 2D accelerometer.

6. The method of claim 1, wherein coupling an accelerometer includes coupling a 3D accelerometer.

7. The method of claim 1, further comprising: coupling one or more additional beam lights, one or more flood lights, and one or more lantern lights dimmable by pulse width modulation or voltage control to the one or more substrates.

8. The method of claim 1, further comprising: installing one or more buttons on the light source body in proximity to the data processor, and coupling the data processor to the one or more buttons.

9. A method to make a self-adaptable light source, comprising:

providing a self-adaptable light source body and a head connected to the self-adaptable light source body, fabricating one or more substrates, wherein the one or more substrates can support a plurality of one or more dimmable lights comprising flood lights and a beam light and a data processor;

coupling one or more batteries to the one or more substrates;

coupling a first accelerometer to the one or more batteries;

coupling the data processor to the first accelerometer;

coupling the plurality of dimmable lights to the data processor to selectively provide a beam light state from the beam light and a flood light state from the flood lights by using one or more dimmable light emitting diodes for the beam light and the flood lights, disposing the beam light and the one or more batteries to a first substrate of the one or more substrates within the light source body;

disposing the flood lights to a second substrate of the one or more substrates within the head, wherein a digital focus of light is selectively provided and adjusted by blending the beam light state of the beam light with the flood light state of the flood light using pulse-width modulation or voltage control of the one or more dimmable light emitting diodes by the data processor, based on a two dimensional position and orientation state of the self-adaptable light source detected by the accelerometer and determined by the data processor where the data processor changes the digital focus of the light provided by the plurality of dimmable lights depending on the rotation of the self-adaptable light source;

coupling a second accelerometer to the data processor and the one or more batteries; and placing the one or more substrates inside the self-adaptable light source body and the head to assemble a complete self-adaptable light source unit.

10. A self-adaptable light source, comprising:

a self-adaptable light source body and a head connected to the self-adaptable light source body;

one or more substrates placed inside the light source body or the head that can support a plurality of dimmable lights comprising flood lights and a beam light and a data processor;

wherein the beam light is disposed on a first substrate of the one or more substrates within the light source body, and wherein the flood lights are disposed on a second substrate of the one or more substrates within the head, wherein one or more batteries is disposed on the first substrate, wherein an accelerometer is coupled to the one or more batteries;

wherein the data processor is coupled to the one or more batteries and the accelerometer; and wherein the plurality of dimmable lights are coupled to the data processor to selectively provide a beam light state from the beam light and a flood light state from the flood lights using one or more dimmable light emitting diodes for the beam light and the flood lights, wherein a digital focus of light is selectively provided and adjusted by blending the beam light state of the beam light with the flood light state of the flood light using pulse-width modulation or voltage control of the one or more dimmable light emitting diodes by the data processor, based on a two dimensional position and orientation state of the self-adaptable light source detected by the accelerometer and determined by the data processor where the data processor changes the digital focus of the light provided by the plurality of dimmable lights depending on the rotation of the self-adaptable light source; and wherein the self-adaptable light source body is assembled with a head.

11. The self-adaptable light source of claim 10, wherein the data processor is a microprocessor or a micro-controller.

12. The self-adaptable light source of claim 10, wherein the data processor controls one or more of the beam lights, one or more of the flood lights, and one or more lantern lights coupled to the one or more substrates dimmable by pulse width modulation or voltage control.

13. The self-adaptable light source of claim 10, wherein the accelerometer is a 1D accelerometer.

14. The self-adaptable light source of claim 10, wherein the accelerometer is a 2D accelerometer.

15. The self-adaptable light source of claim 10, wherein the accelerometer is a 3D accelerometer.

16. The self-adaptable light source of claim 10, wherein the second accelerometer detects changes in motion or position that is coupled to the data processor.

17. The self-adaptable light source of claim 10, wherein the self-adaptable light source has a longitudinal axis and the digital focus of light can be achieved by a user rotating the self-adaptable light source around one axis of the self-adaptable light source.

18. The self-adaptable light source of claim 10, wherein one or more buttons coupled to the light source body include one or more capacitive sense touch buttons coupled to the data processor.

* * * * *